United States Patent [19]

Bousquet

[11] 4,092,890

[45] June 6, 1978

[54] STENCIL-CUTTING MACHINE

[75] Inventor: Jacques Bousquet, Poncin, France

[73] Assignee: Etablissements Tiflex Société Anonyme, Poncin, France

[21] Appl. No.: 782,444

[22] Filed: Mar. 29, 1977

[51] Int. Cl.[2] ..... B26F 1/00

[52] U.S. Cl. ..... 83/284; 83/655; 83/699

[58] Field of Search ..... 83/284, 652, 655, 699

[56] References Cited

U.S. PATENT DOCUMENTS

| | | | |
|---|---|---|---|
| 1,048,775 | 12/1912 | Wilkinson | 83/284 |
| 2,121,004 | 6/1938 | Balfe | 83/531 X |
| 3,089,376 | 5/1963 | Whistler et al. | 83/699 |
| 3,199,390 | 8/1965 | Arnould et al. | 83/284 |
| 3,237,499 | 3/1966 | Lohrand et al. | 83/284 X |
| 3,301,110 | 1/1967 | Stegner | 83/284 X |
| 3,800,641 | 4/1974 | Spengler | 83/284 X |
| 3,867,859 | 2/1975 | Hirons | 83/284 |

*Primary Examiner*—J. M. Meister
*Attorney, Agent, or Firm*—Karl F. Ross

[57] ABSTRACT

A stencil-cutting machine comprises a support adapted to receive a ferrous-metal plate upon which a plurality of cutting dies can be mounted to pass between a pair of rollers, at least one of which can be rotated, e.g. by a handle. Guide means is provided on the support for enabling the plate to move between the rollers with a stencil cardboard overlying the cutting dies and overlain, in turn, by a yieldable blanket. Magnetic alignment rules are provided on the plate to assist in aligning the dies and, at the end of a row of such dies, magnetic blocking members can be provided to hold them in place.

7 Claims, 3 Drawing Figures

STENCIL-CUTTING MACHINE

FIELD OF THE INVENTION

The present invention relates to a machine for cutting stencils and, more particularly, to an apparatus for cutting cardboard stencils adapted to replicate a phrase, pattern or other text of alphanumerical indicia upon a surface by applying ink to the stencil and thereby printing through openings cut in the carboard.

BACKGROUND OF THE INVENTION

For the reproduction of alphanumerical indicia, patterns and the like, it is common practice to employ cardboard or paper stencils which have previously been formed with openings of the desired pattern and through which ink is rubbed, wiped or sprayed to apply a pattern corresponding to that of the openings to a surface. Such stencils are used to a considerable extent in shipping departments or the like where a particular alphanumerical text must be applied to packing cases or the like in quantity.

The preparation of such stencils has heretofore been carried out in various ways. For example, a metal master having a single letter or in the form of a frame provided with a number of alpha numerical patterns can be applied to a paper layer and openings can be cut in the latter using a stylus or blade. Variour machines have also been provided for this purpose, although most of them have been relatively complex, difficult to set up and inconvenient to use. For example, it is frequently required to make cutting dies in a reverse or mirror-image pattern so that the stencil will have the desired orientation when cut.

OBJECTS OF THE INVENTION

It is the principal object of the present invention to provide a machine for the cutting of stencils which is simple, rapid and versatile and which obviates the disadvantages of earlier systems for the preparation of cardboard stencils.

Another object of the invention is to provide an improved apparatus for the cutting of cardboard stencils, comprising a text to be reproduced and formed from a variety of characters: letters, numerals, signs and symbols.

Still another object of the invention is to provide an apparatus for the purposes described which facilitates the composition of the desired text before a corresponding pattern is cut into cardboard to form a stencil.

SUMMARY OF THE INVENTION

These objects and other which will become apparent hereinafter are attained, in accordance with the present invention, in an apparatus for cutting cardboard stencils which comprises a press constituted by at least two superposed rollers separated by a gap adapted to be traversed by a plate mounted to slide between the rollers. The plate constitutes a setting tray adapted to receive character-forming dies with upstanding cutting edges disposed on the plate in the composition of the desired text. Means is provided for driving at least one of the rollers.

Upon composition of the desired text, cutting of the stencil can thus be effected in a single operation. It suffices to position a cardboard layer or web adapted to form the stencil upon the plate, i.e. above the array of dies, and to cover this layer of cardboard with a yieldable web or blanket. The assembly of plate, dies, cardboard and blanket is thus passed, on suitable guides, between the rollers which press the blanket and cardboard against the cutting edges of the die, thereby perforating the cardboard in the pattern of the dies disposed on the plate.

In one embodiment of the invention, the press comprises an upper pressing roller and a supporting roller (lower roller) disposed beneath the setting tray. The two rollers are spaced vertically by a gap which is substantially equal to the combined thickness of the plate and the cutting dies.

According to another feature of the invention, the support is provided with a pair of guides along which the plate or tray is shiftable, the guides defining a plane of sliding movement for the tray which is substantially parallel to the horizontal and generally tangential to the underlying supporting roller as well as the overlying pressure roller. It has been found to be advantageous, moreover, to provide, flanking the supporting roller, a further pair of rollers which function as guide rollers preventing canting of the plate or tray. The supporting roller that is preferably the driven roller according to a feature of the invention and can be connected to a handwheel by a gear arrangement.

According to still another feature of the invention, the plate of tray is composed of a ferromagnetic material, i.e. a magnetically attractable material and the tray is provided with magnetic alignment rules whereby the dies can be aligned to form the text. The row of dies forming the text can be held in place at its end by so-called blocking wedges which are also magnetic and are held by magnetic force upon the plate or tray.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
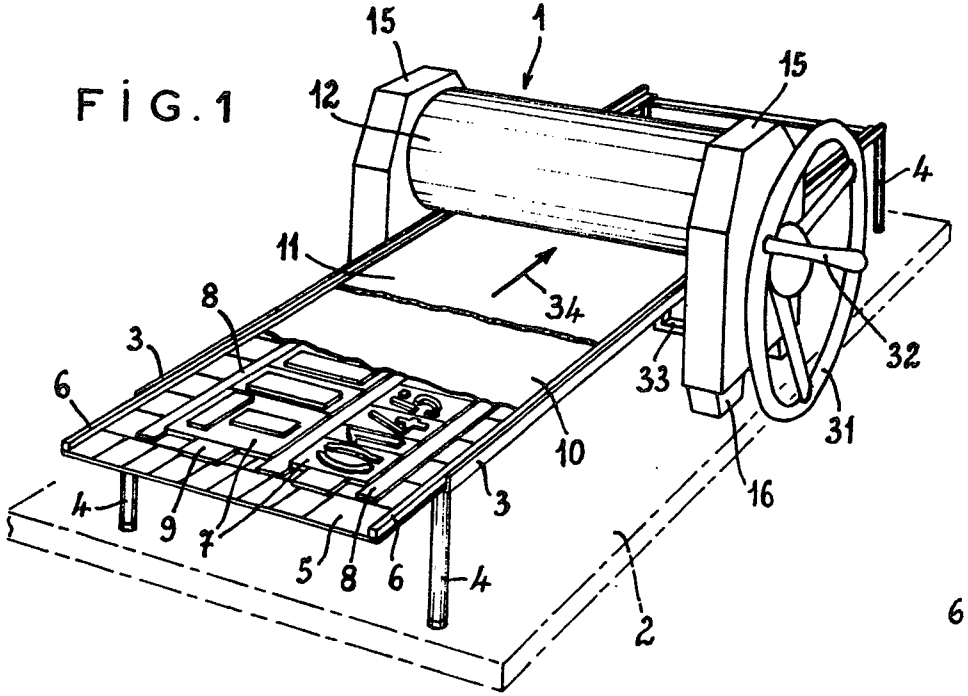
FIG. 1 is a perspective view, partly broken away, of an apparatus for cutting stencils according to the present invention.

As will be apparent from FIG. 1, the stencil-cutting machine according to the invention comprises a press 1 which can be mounted on a worktable 2 by legs 4 which support the press via a pair of guide rails 3 which are horizontally spaced apart and are parallel to one another, lying in a horizontal plane.

Figure 3:
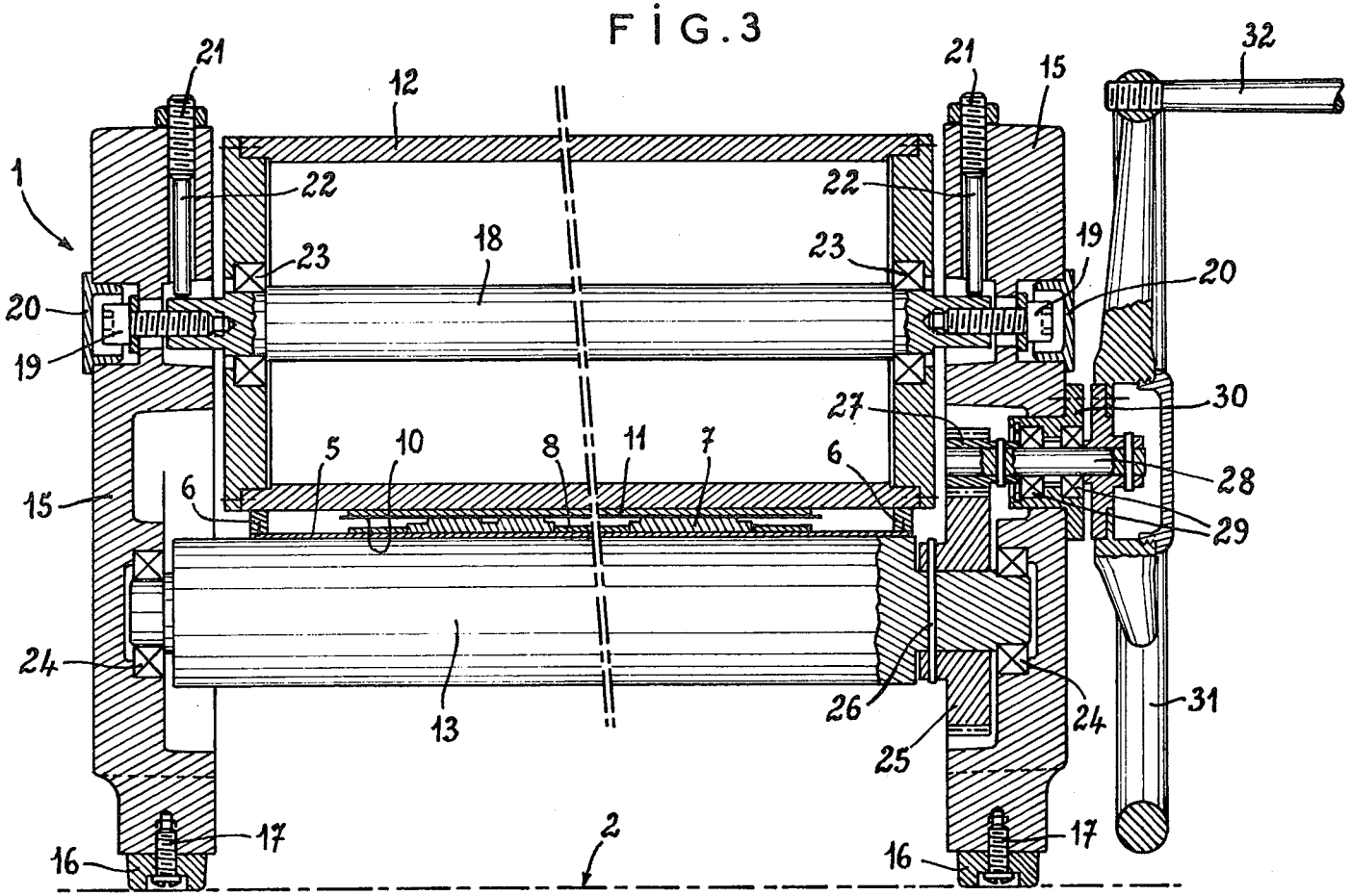
FIG. 3 is a cross-sectional view taken along the line III—III of FIG. 2 through an apparatus of the type shown in FIG. 1.

The guide rails 3 slidably carry a horizontal composition plate or setting tray whosse two longitudinal edges parallel to the rails 3 are, in turn, formed with entrainment rails 6 which are shown in section in FIG. 3.

The plate 5 is provided with cutting dies 7 having the desired characters adapted to form corresponding openings in the cardboard stencil, these characters being outlined by upstanding cutting edges. The rows of dies are maintained in place between longitudinal alignment rules 8 which are magnetic and hence adhere by magnetic force to the ferromagnetic plate 5.

At their ends, each row of dies 7 is fixed by so-called blocking wedges which are also magnetic. The locking wedges are represented at 9.

The composition of the stencil text using the rectangular dies is facilitated by lines traced on the plate 5 parallel to its longitudinal and transverse edges and forming a grid pattern as will be apparent from FIG. 1. This ensures that the text of the stencil will be parallel to the longitudinal edges of the cardboard in which the text is to be formed.

In operation, the dies 7 are first covered by a stencil cardboard 10 of desired size and configuration and the latter is covered, in turn, by a yieldable blanket, e.g. of paper, 11. The cardboard 10 and the blanket 11 are so disposed that they do not cover the entrainment rails 6 of the plate 5.

The assembly formed by the plate 5, the dies or matrices 7, the cardboard sheet 10 and the blanket 11 is passed through the press 1, between an upper pressing roller 12 and a lower supporting roller 13, separated by the gap whose width is determined by the height of the entrainment rails 6 and which corresponds substantially to the thickness of the dies 7 and part of the thickness of the blanket 11.

Figure 2:
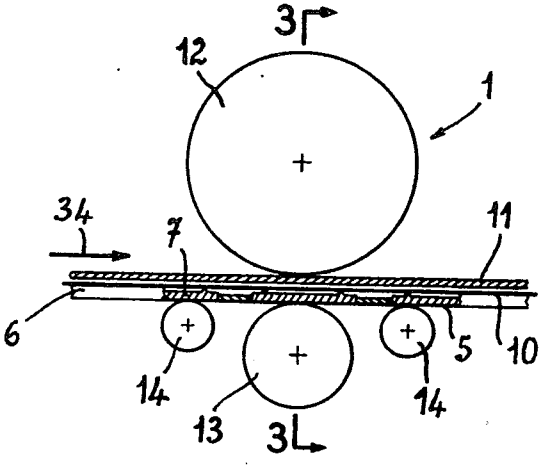
FIG. 2 is a diagrammatic side view showing the arrangements of the rollers according to the invention, partly in section.

Two supporting rollers 14, parallel to the supporting roller 13, flank the latter and engage the underside of plate 5 as shown in FIG. 2.

The details of the construction of press 1 can be seen from FIG. 3.

A pair of lateral side plates for upright supports 15, mounted on rubber feet 16 by screws 17, are thereby supported on the table 2. Between the two supports 15, there is mounted a horizontal shaft 18 anchored at its extremities by screws 19, the heads of which are covered by plugs 20 received in recesses of the lateral support plates 15. The shaft 18 is fixed against rotation by a pair of radial screws 21 which act upon pins 22 which are pressed against shanks of the shaft 18.

The shaft 18 also carries, by means of a pair of bearings 23, a freely rotatable drum constituting the upper roller 12. The support plates 15, constituted as cheek plates, also receive the bearings 24 which mount the lower roller 13 for rotations. The rollers 12 and 13 are thus rotatable about parallel horizontal axes lying in a common vertical plane perpendicular to the plane of the setting tray or plate 5.

The supporting roller 13 also serves as the entrainment roller for the plate 5. To this end, a first gear 25 is connected to the roller 13 by a pin 26 so as to rotatably entrain the roller 13. The gear 25 meshes with a pinion 27 mounted for rotation on a shaft 28 journaled in bearings 29 of a bearing housing 30 fixed to the right hand cheek plate 15. A handwheel 31 is affixed at the right hand end of the shaft 28 (FIG. 3) and has a handle 32 projecting outwardly from the wheel for greater leverage. Upon rotation of the wheel 31, therefore, the gear 27 is rotated, thereby driving the gear 25 and the roller 13 to which the latter is affixed.

The cheek plates 15 also are provided with supports 33, one of which is visible in FIG. 1, which carry the guide rails 3 previously mentioned, the guide rails 3 being interrupted in the region of the rollers 12 and 13 of the press.

After composition of the desired text by means of the dies 7 upon the composition tray 5, and formation of the assembly 7, 10, 11 as described, the perforation of the cardboard sheet 10 is obtained by rotating the wheel 31, thereby entraining the supporting roller 13 and advancing the plate 5, whose entrainment rails 6 are pressed between the rollers 12 and 13, toward the rear (FIG. 1) as represented by arrow 34. The plate is guided during this movement between the rails 3. The parts of the die 7 in relief, i.e. the cutting edges, thus pierce through the cardboard 10 and form a corresponding opening in the stencil sheet. If it is desired to cut a plurality of stencils which are identical, it is merely necessary to remove the previously cut stencil and the blanket, extract any portions cut out from the dies or matrices 7, place another cardboard sheet 10 upon the latter and a blanket 11 thereover, after the plate 5 has been withdrawn in the opposite direction, and repeat the process.

I claim:

1. An apparatus for cutting stencils in a sheet, comprising a support, a press formed on said support and comprising a pair of superposed rollers separated by a gap, a plate, composed of ferromagnetic material slidably mounted on a support and shiftable between said rollers, alphanumeric - character cutting dies disposed on said plate and adapted to pierce said sheet upon said sheet being disposed on said dies, said dies lying on said plate and having upwardly turned cutting edges, means for rotatably displacing at least one of said rollers to advance said plate, said dies and said sheet between said rollers, whereby said rollers press said sheet against said dies, said support being provided with a pair of guide rails slidably receiving said plate and engaging opposite longitudinal edges thereof, said plate being provided with a pair of entrainment rails along its opposite longitudinal edges parallel to said guide rails and receivable between said support roller and said pressing roller for advancing said plate between said rollers; and at least one magnetic alignment rule overlying said plate and magnetically adherent thereto for lining up of said dies on said plate.

2. The apparatus defined in claim 1 wherein said rollers include an upper pressing roller and a lower supporting roller separated by said gap, said supporting roller being flanked by a further pair of rollers engaging the bottom of said plate.

3. The apparatus defined in claim 2 wherein said means for rotatably displacing at least one of said rollers is operatively connected to said support roller for rotating same.

4. The apparatus defined in claim 1 wherein said dies are adapted to be disposed in rows, further comprising a pair of locking wedges magnetically adherent to said plate for retaining the dies at opposite ends of a row against movement.

5. The apparatus defined in claim 4 wherein said support comprises a pair of uprights flanking said rollers, a fixed shaft bridging said uprights of both said plates and fixed to said uprights, said pressing roller being freely rotatable on said shaft, and a pair of bearings rotatably supporting said support roller, said bearings being received in said uprights, said means for rotatably displacing said support roller comprising a first gear connected to said support roller, a second gear meshing with said first gear, another shaft journaled in one of said uprights and carrying said second gear, and a handwheel connected to said further shaft for rotating same.

6. The apparatus defined in claim 5 wherein said uprights are mounted by rubber feet upon a supporting surface.

7. The apparatus defined in claim 1 wherein said guide rails are provided with legs resting upon a supporting surface.

* * * * *